US006892736B2

(12) United States Patent
Chang et al.

(10) Patent No.: US 6,892,736 B2
(45) Date of Patent: May 17, 2005

(54) ARTIFICIAL NAIL HAVING APPLICATION TAB

(75) Inventors: Sung Yong Chang, Roslyn Heights, NY (US); Grace A. Tallon, New York, NY (US)

(73) Assignee: KMC Exim Corp., Port Washington, NY (US)

( * ) Notice: Subject to any disclaimer, the term of this patent is extended or adjusted under 35 U.S.C. 154(b) by 81 days.

(21) Appl. No.: 10/383,383

(22) Filed: Mar. 7, 2003

(65) Prior Publication Data

US 2004/0173232 A1 Sep. 9, 2004

(51) Int. Cl.[7] ..... A45D 31/00
(52) U.S. Cl. ..... 132/73
(58) Field of Search ..... 132/73, 73.5, 285, 132/286, 319; D28/56, 57, 61, 62

(56) References Cited

U.S. PATENT DOCUMENTS

| | | | | | |
|---|---|---|---|---|---|
| 2,239,040 | A | * | 4/1941 | Holmes | 132/285 |
| D136,030 | S | * | 7/1943 | Belmonte et al. | D28/56 |
| 2,417,677 | A | * | 3/1947 | Cohan | 434/100 |
| 2,941,535 | A | * | 6/1960 | Lappe | 132/73 |
| 3,157,912 | A | * | 11/1964 | Lisczawka | 425/2 |
| 3,578,158 | A | * | 5/1971 | Aylott | 206/509 |
| 3,722,104 | A | * | 3/1973 | Enzetti | 33/512 |
| 3,982,551 | A | | 9/1976 | Bartolucci | |
| 3,993,084 | A | * | 11/1976 | Cullen | 132/73 |
| 4,106,614 | A | * | 8/1978 | Aylott | 206/581 |
| 4,554,935 | A | * | 11/1985 | Hokama | 132/73 |
| 4,718,957 | A | | 1/1988 | Sensenbrenner | |
| 4,805,645 | A | * | 2/1989 | Schiff et al. | 132/73 |
| D309,196 | S | * | 7/1990 | LaJoie | D28/56 |
| 5,005,595 | A | * | 4/1991 | Aylott | 132/73 |
| 5,060,678 | A | * | 10/1991 | Bauman et al. | 132/73 |
| 5,450,864 | A | * | 9/1995 | LaJoie et al. | 132/73 |
| D376,224 | S | * | 12/1996 | Fojon | D28/56 |
| D386,823 | S | * | 11/1997 | Carroll et al. | D28/56 |
| 5,816,408 | A | * | 10/1998 | Indelicato | 206/581 |
| 5,832,936 | A | * | 11/1998 | Pruchnic et al. | 132/73 |
| 5,860,429 | A | * | 1/1999 | Chang | 132/73 |
| 5,901,714 | A | * | 5/1999 | Benkart | 132/285 |
| D433,536 | S | * | 11/2000 | Schwartz | D28/56 |
| D455,866 | S | * | 4/2002 | Baltierra | D28/56 |
| 2003/0178040 | A1 | * | 9/2003 | Swensen | 132/73 |

* cited by examiner

*Primary Examiner*—Todd E. Manahan
*Assistant Examiner*—David Comstock
(74) *Attorney, Agent, or Firm*—Hoffmann & Baron, LLP

(57) ABSTRACT

An artificial nail for attachment to a natural nail includes a nail body having a proximal end sized and shaped to be attachable to the top surface of the natural nail and a distal end opposite the proximal end. Extending outwardly from the distal end of the nail body is an application tab which is adapted to be grasped during attachment of the nail body to the natural nail.

23 Claims, 5 Drawing Sheets

ARTIFICIAL NAIL HAVING APPLICATION TAB

BACKGROUND OF THE INVENTION

The present invention relates generally to artificial nails that are applied to natural nails with an adhesive, and more particularly to an artificial nail having an application tab for aiding the application of the artificial nail to the natural nail.

Artificial nails have been used for many years to enhance the cosmetic appearance of the fingers. Some individuals opt to use artificial nails because their own nails are too weak to grow to a desirable length without breaking. Others choose artificial nails because they are considerably stronger and more durable than natural nails, and because nail polish adheres better to the artificial nail surface. Some individuals are unhappy with the shape and contour of their natural nail and opt to use an artificial nail to improve the appearance of their nails.

It has been known in the art of adorning the hands to provide ornamental fingernail accessories made from thin, molded plastic members manufactured generally in the shape of a fingernail. Indeed, numerous artificial fingernail manufacturers have provided a variety of combinations of materials, arrangements, and colors in fingernail accessories. For example, many conventional pre-designed fingernails often include a decorative design stenciled or air-brushed on a top surface thereof.

With the advent of such artificial fingernail accessories, the wearer could now have intricately pre-designed fingernails that are attached to the natural fingernail and then later easily removed. The pre-designed artificial nail is glued to the surface of the natural nail by applying an amount of a liquid bonding adhesive to the bottom surface of the artificial nail and/or the top surface of the natural nail to affix the accessory to the nail. Usually the wearer must wipe or trim away any excess adhesive and then wait several moments until the adhesive dries to ensure that the accessory is secured to the nail. An overlay is then typically applied to the entire top surface of the artificial nail. The overlay is usually transparent or translucent so that the decorative design is visible on the top surface of the artificial nail. Once the overlay sets, the artificial nail is shaped as desired.

One drawback with artificial nails, however, is that the application process can be cumbersome and messy. In particular, in attaching an artificial nail, it is necessary to grasp the artificial nail itself and apply glue to the bottom side of the nail. The artificial nail is then turned over so the glued bottom side faces downward whereby the artificial nail can be positioned on the natural nail. Once the artificial nail is properly placed, a slight pressure must be placed on the nail so that the glue sufficiently secures the artificial nail to the natural nail. Because the artificial nail is being held between the fingers of the opposite hand during this entire process, the applied glue often comes in contact with the fingers. Not only may this detrimentally alter the adhesive bonding characteristics of the glue, but it also makes handling of the artificial nail difficult. Cleaning the glue from the fingers between each nail application also makes the process more time consuming.

Accordingly, it would desirable to provide an artificial nail that can be applied to the natural nail without the aforementioned drawbacks. In particular, it would be desirable to provide an artificial nail that can be easily handled during application and which minimizes the chance of glue coming into contact with the fingers.

SUMMARY OF THE INVENTION

The present invention is an artificial nail for attachment to a natural nail which includes a nail body having a proximal end sized and shaped to be attachable to the top surface of the natural nail and a distal end opposite the proximal end. Extending outwardly from the distal end of the nail body is an application tab which is adapted to be grasped during attachment of the nail body to the natural nail.

The application tab is preferably integrally molded along with the nail body and includes a frangible portion, which is preferably a perforation, adjacent the distal end of the nail body for detaching the application tab from the nail body. Additionally, the application tab is preferably in the shape of a flat disk to allow easy grasping and detaching. Also, the application tab preferably includes indicia indicating a size, such as width, lateral curvature and/or longitudinal curvature, of the nail body.

"Artificial nail", as used herein also includes fingernail extensions, referred to in the trade as "tips". Thus, the artificial nail may be a full cover, wherein the proximal end of the nail body is sized and shaped to substantially correspond to the full nail bed of the natural nail, or the artificial nail may be a nail tip, wherein the proximal end of the nail body is sized and shaped to be attachable to only the distal end of the natural nail.

The present invention further involves a set of artificial nails for attachment to natural nails. The set includes at least one nail body having a proximal end sized and shaped to be attachable to the top surface of the natural nail, a distal end opposite the proximal end and a peripheral edge. An application tab extends outwardly from the peripheral edge of the nail body at a first location and has a surface adapted to be grasped during attachment of the nail body to the natural nail. The nail body is temporarily supported on a supporting structure which includes a frangible stem detachably connected to the peripheral edge of the nail body at a second location away from the application tab. Alternatively, the frangible stem of the supporting structure may be connected directly to the application tab. Preferably, the nail body, the application tab and the supporting structure are integrally molded.

As a result of the present invention, an artificial nail having an application tab, which eliminates the cumbersome and messy aspects of artificial nail application, is provided. In particular, an artificial nail is provided which can be easily handled during application and which minimizes the chance of glue coming into contact with the fingers.

Other objects and features of the present invention will become apparent from the following detailed description considered in conjunction with the accompanying drawings. It is to be understood, however, that the drawings are designed as an illustration only and not as a definition of the limits of the invention.

DETAILED DESCRIPTION OF THE PREFERRED EMBODIMENTS

Figure 1:
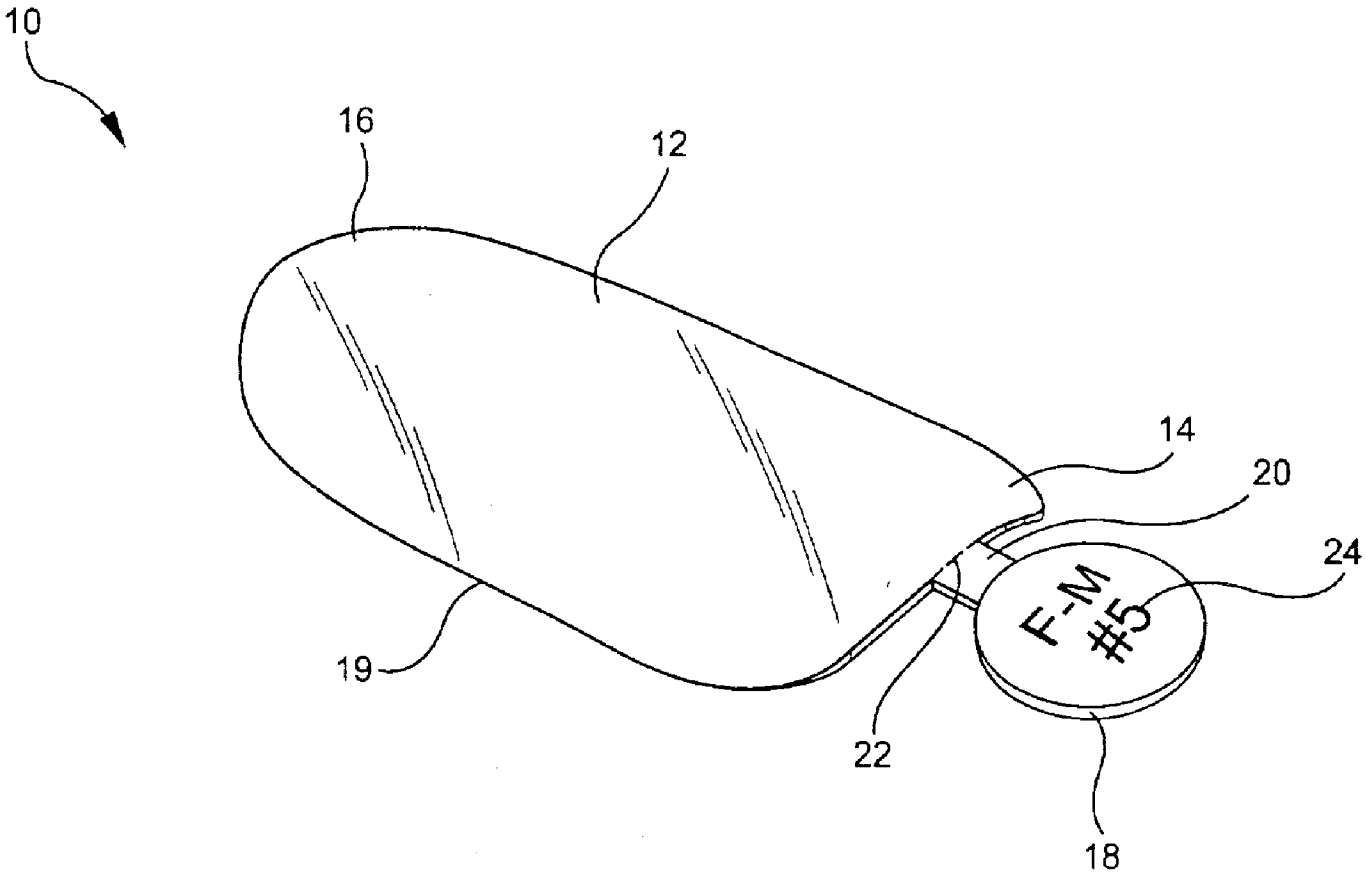
FIG. 1 is a top perspective view of an artificial nail having an application tab formed in accordance with the present invention.

Referring first to FIG. 1, an artificial nail 10 formed in accordance with the present invention is shown. The artificial nail 10 includes a one-piece molded body 12 having a distal end 14 and a proximal end 16 opposite the distal end. The proximal end 16 and, more particularly, the bottom surface adjacent the proximal end is sized and shaped to be attachable to the top surface of a natural nail. The distal end 14 may be sized to extend beyond the end of the natural nail when the artificial nail is attached thereto or it may be sized to coincide with the end of the natural nail.

The nail body 12 can be rounded or it can be straight and it is not limited to any particular dimensions. In other words, the artificial nail 10 of the present invention is useful for fingernails and/or toenails and can be made in a variety of sizes and shapes. For instance, the proximal end 16 of the nail body 12 may substantially correspond in size and shape to the full nail bed of a natural fingernail, whereby the artificial nail is termed a full nail cover that is applied over the full nail bed of a natural fingernail. Alternatively, the proximal end 16 may be attachable to only the distal end of a natural fingernail, that is, for example, it may correspond in size and shape to only the distal end of the natural nail bed, whereby the artificial nail is termed a nail tip that is applied to the end of the natural fingernail. Once properly applied, however, it is often difficult to distinguish a tip from a cover.

Extending outwardly from the distal end 14 of the nail body 12 is an application tab 18 which is adapted to be grasped between the thumb and the forefinger to aid in attachment of the artificial nail 10 to a natural nail. The application tab 18 is generally a flat piece of plastic material connected to the distal end 14 of the nail body 12 and is, therefore, preferably integrally molded together with the nail body 12. It has been found that the most convenient place for the application tab 18 is at the distal end 14 of the nail body 12. However, it is conceivable that the application tab 18 can be connected to a peripheral edge 19 of the nail body 12 at any location.

Both the nail body 12 and the application tab 18 may be injection molded from a plastic material such as ABS plastic. The application tab 18 is preferably in the shape of a flat circular or oval disk having a thickness generally equal to the thickness of the nail body 12. The flat disk shape of the application tab 18 lends itself well to comfortable and secure grasping of the nail 10 during application.

The application tab 18 further preferably includes a frangible portion 20 adjacent the distal end 14 of the nail body 12 for detaching the application tab from the nail body. The frangible portion 20 preferably includes a perforation 22 which is aligned with the distal end 14 of the nail body 12. In this way, the application tab 18 can be easily and cleanly removed from the nail body 12, after attachment to the natural nail, with a minimum amount of subsequent filing of the nail body required.

Additionally, the application tab 18 further preferably includes indicia 24 indicating the size of the nail 10. The indicia 24 may be molded or etched into the application tab or may be applied by any conventional means. The indicia 24 may indicate the size of the nail body 12 in terms of width, such as by industry recognized sizes ranging from #1 (largest) to #15 (smallest). Alternatively, or preferably in addition to, the indicia 24 may indicate the size of the nail body 12 in terms of lateral and/or longitudinal curvature of the nail 10. For example, it has been found that because the natural nails vary in both lateral and longitudinal curvature from person to person, it is preferable to provide artificial nails to accommodate these variances. Thus, the nails 10 can be provided with lateral curvatures ranging from extra flat (EF), flat (F), regular (R), high (H) and extra high (EH). Similarly, the nails 10 can be provided with longitudinal curvatures of medium (M) and curved (C). In this manner, a #5 width nail having a flat lateral curvature and a medium longitudinal curvature would include an application tab 18 having indicia reading "F-M #5" as shown in FIG. 1.

Figure 2:
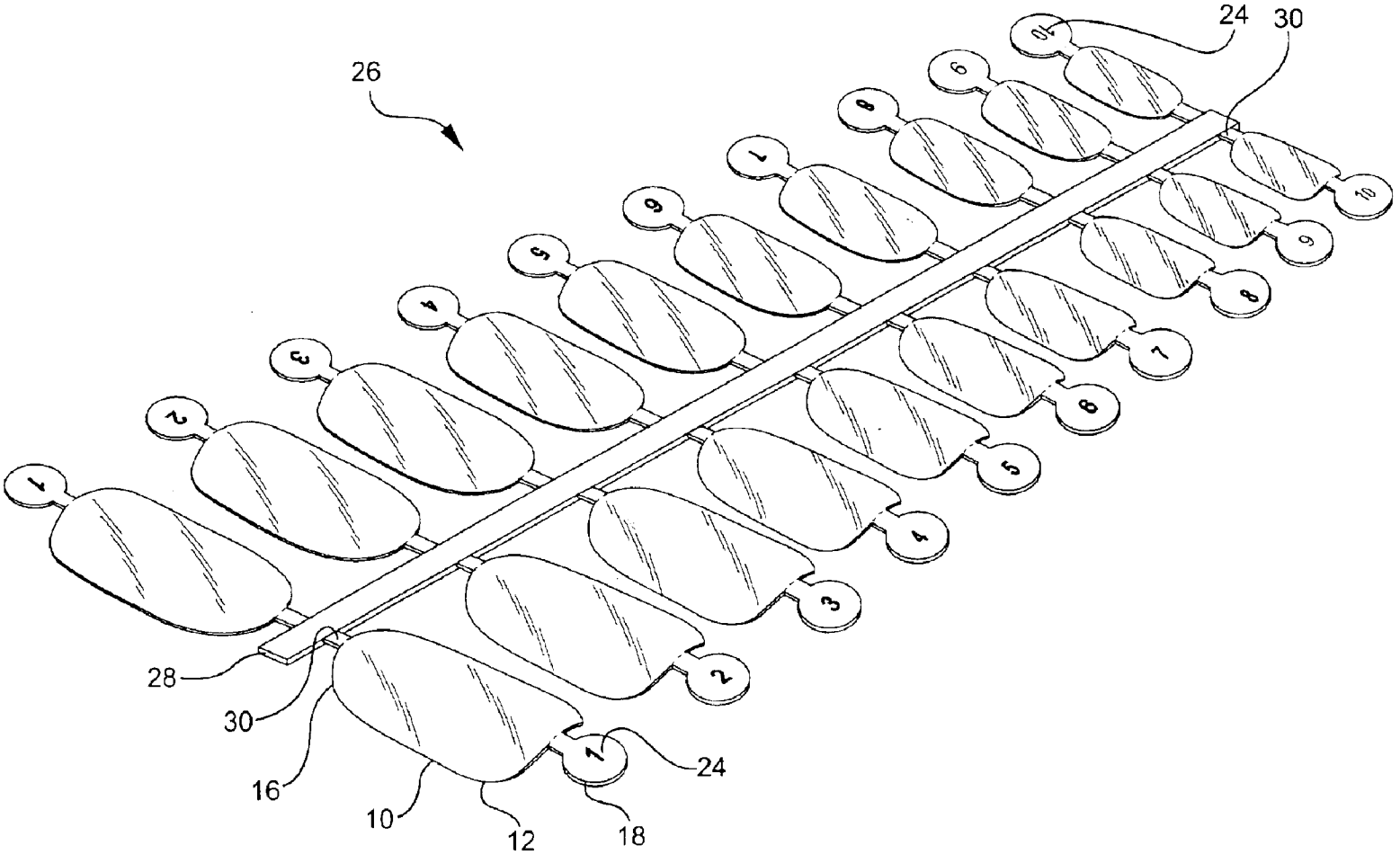
FIG. 2 is a top perspective view of a set of differently sized artificial nails as shown in FIG. 1.

FIG. 2 illustrates a typical set 26 of artificial nails 10 formed in accordance with the present invention. The set 26 is preferably fabricated by injection molding as a unitary part including a plurality of spaced differently sized nails 10 connected to a supporting structure 28, such as a central tree. Each of the nails 10 includes a nail body 12 and an application tab 18, as described above, and is preferably connected to the supporting structure 28 at its proximal end 16. Thus, the application tab 18 of each nail 10 extends outwardly from the supporting structure 28 so that the user can readily see the respective sizes of the nails. Preferably, the nails 10 are arranged on the supporting structure 28 in an aesthetically pleasing, as well as functional pattern. In particular, the nails 10 are preferably arranged in order of size and are positioned side-by-side along the supporting structure 28. Since all the nails 10 are molded integrally with the supporting structure 28, the entire set of nails is rendered relatively easy to manufacture and to handle for subsequent packaging and use.

Figure 3:
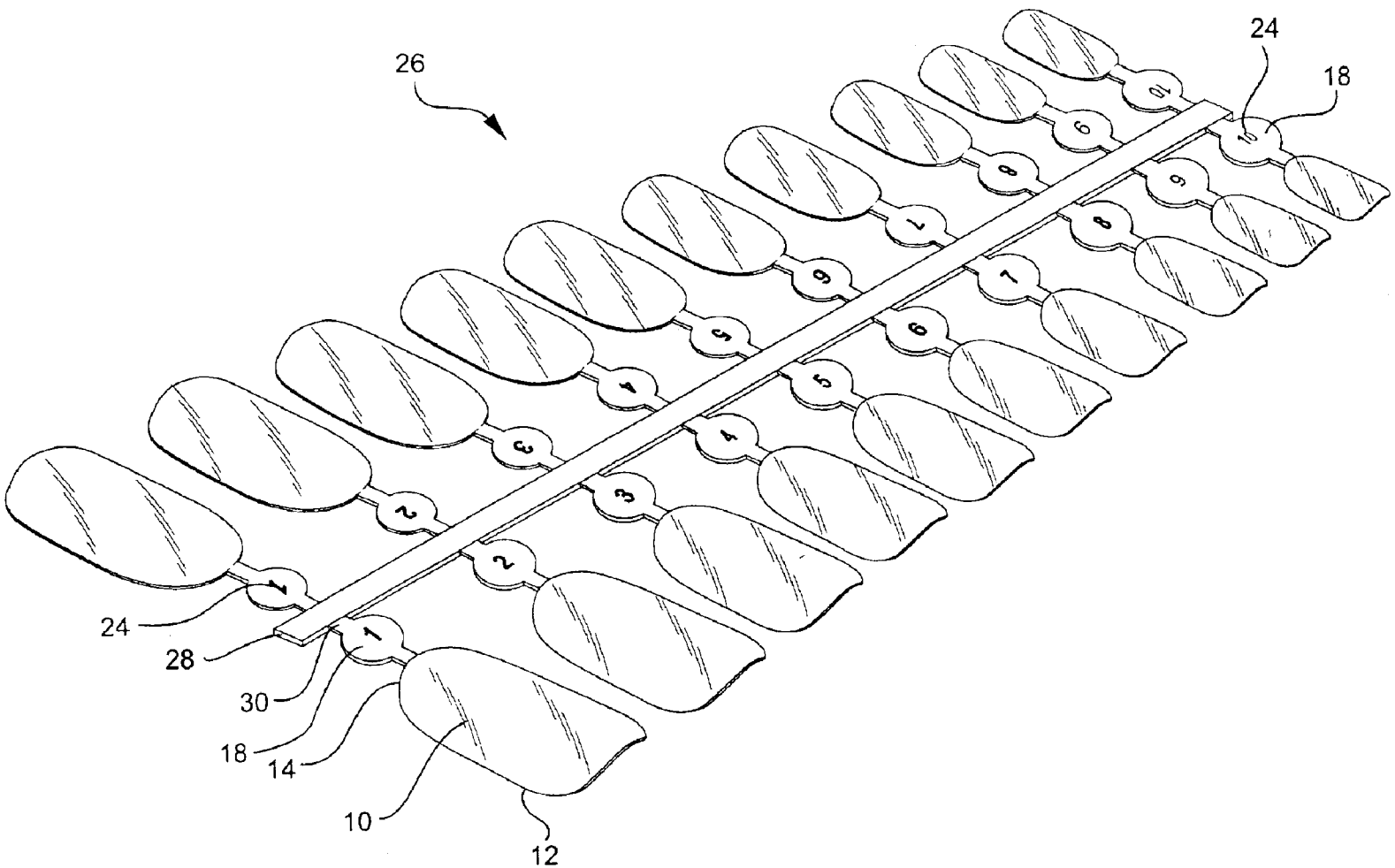
FIG. 3 is a top perspective view of an alternative embodiment of a set of differently sized artificial nails as shown in FIG. 1.

When it is desired to attach the artificial nails 10, the user may first select the desired nail size based on the indicia 24 shown on each nail's respective application tab 18. The user may then grasp the application tab 18 of the selected nail 10 between the thumb and forefinger and easily detach the nail from the supporting structure 28. In this regard, the supporting structure 28 preferably includes a frangible or breakable stem 30 connected to the proximal end 16 of each nail body 12, which enables the nails 10 to be manually snapped off the tree without damaging the nail bodies 12. As described, it is preferable to connect the nail body 12 to the supporting structure 28 via the frangible stem 30 at the proximal end 16 of the nail body. However, it is conceivable that the stem 30 of the supporting structure 28 can be detachably connected to the peripheral edge 19 of the nail body 12 at any location around the nail body periphery. Indeed, it is also conceivable that the stem 30 of the supporting structure can be detachably connected directly to the application tab 18, as shown in FIG. 3.

Figure 4:
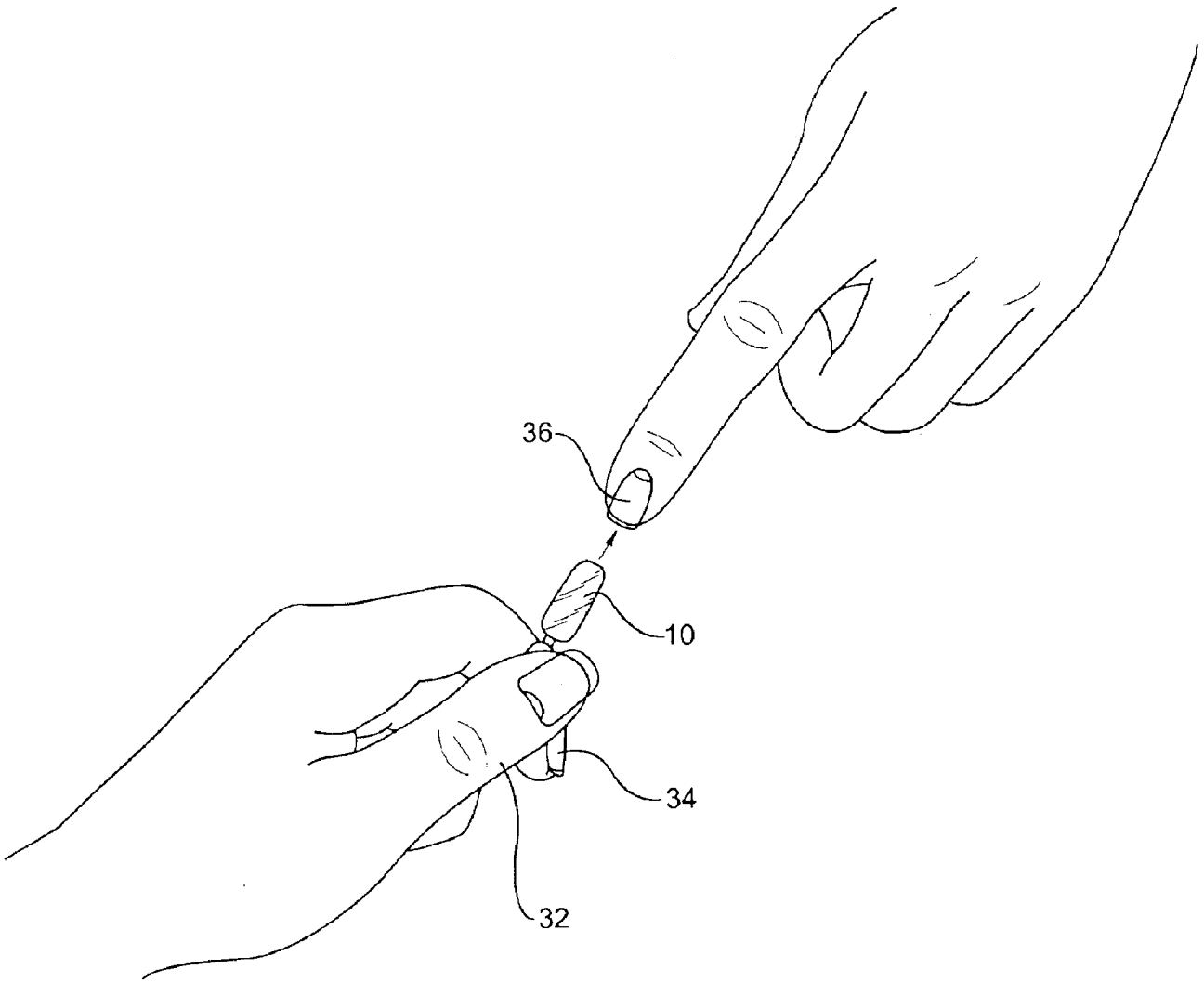
FIG. 4 is a top perspective view of the artificial nail shown in FIG. 1 being applied to a natural nail.
Figure 5:
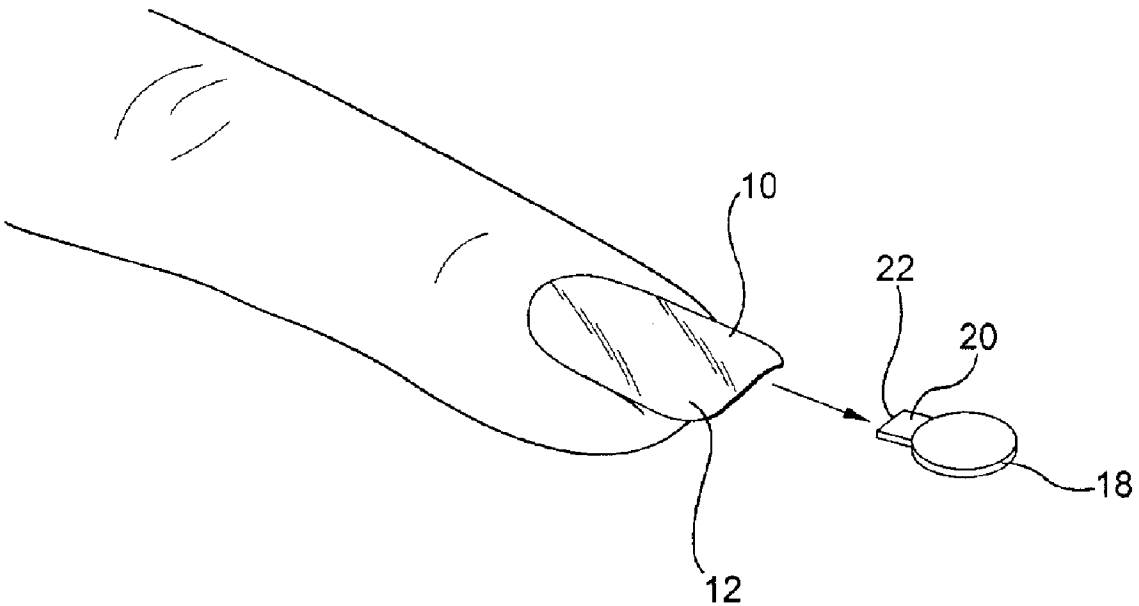
FIG. 5 is a top perspective view of the artificial nail shown in FIG. 1 with the application tab being detached.

Referring now to FIGS. 4 and 5, with the application tab 18 still easily grasped between the thumb 32 and forefinger 34 of the opposite hand, glue is applied to the bottom side of the nail and/or the top surface of the natural nail 36. The artificial nail 10 is then turned over by manipulating the application tab 18 so the glued bottom side faces downward whereby the artificial nail can be positioned on the natural nail 36. Once the artificial nail 10 is properly placed, a slight pressure can be applied on the nail, via the application tab 18, so that the glue can sufficiently secure the artificial nail to the natural nail 36.

Once the nail 10 is sufficiently adhered to the natural nail 36, the application tab 18 is detached from the nail body 12 by snapping, tearing or breaking the frangible portion 20. As mentioned above, the frangible portion 20 preferably includes a perforation 22 which allows for clean removal of the application tab 18 and thereby eliminates or minimizes subsequent filing or shaping of the nail 10. Since only the application tab 18, which is relatively remote from the glued surfaces, is handled by the fingers during this entire process, the applied glue does not come into contact with the fingers. Thus, the adhesive bonding characteristics of the glue is maintained and there is no need for cleaning the glue from the fingers between each nail application. As a result of the present invention, an artificial nail is provided which can be easily handled during application and which minimizes the chance of glue coming into contact with the fingers.

While there has been described what is presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. An artificial nail for attachment to a natural nail comprising:

a nail body having a proximal end sized and shaped to be attachable to the top surface of the natural nail and a distal end opposite said proximal end, said distal end defining a distal edge; and an application tab not comprising a supporting structure extending outwardly from said distal edge of said nail body, said application tab being adapted to be grasped during attachment of said nail body to the natural nail and having a narrowed frangible stem portion adjacent said distal edge of said nail body for detaching said application tab from said body, wherein the frangible portion comprises means for allowing the application tab to be easily and cleanly removed from the nail body, without damage to the nail body, by snapping, tearing or breaking, and eliminating or minimizing the need for subsequent filing or shaping of the nail body.

2. An artificial nail as defined in claim 1, wherein said frangible portion includes a perforation.

3. An artificial nail as defined in claim 1, wherein said application tab is in the shape of a flat disk.

4. An artificial nail as defined in claim 1, wherein said application tab includes indicia indicating a size of said nail body.

5. An artificial nail as defined in claim 4, wherein said indicia indicates a curvature of said nail body.

6. An artificial nail as defined in claim 1, wherein said nail body and said application tab are integrally molded.

7. An artificial nail for attachment to a natural nail comprising:

a nail body having a proximal end sized and shaped to be attachable to the top surface of the natural nail and a distal end opposite said proximal end, said distal end defining a distal edge; and an application tab not comprising a supporting structure extending outwardly from said distal edge of said nail body, said application tab having a surface adapted to be grasped during attachment of said nail body to the natural nail and having a frangible portion adjacent said distal edge of said nail body for detaching said application tab from said nail body, said frangible portion being narrower than said surface and said surface including indicia indicating a size of said nail body, wherein the frangible portion comprises means for allowing the application tab to be easily and cleanly removed from the nail body, without damage to the nail body, by snapping, tearing or breaking, and eliminating or minimizing the need for subsequent filing or shaping of the nail body.

8. An artificial nail as defined in claim 7, wherein said frangible portion includes a perforation.

9. An artificial nail as defined in claim 7, wherein said application tab is in the shape of a flat disk.

10. An artificial nail as defined in claim 7, wherein said indicia indicates a curvature of said nail body.

11. An artificial nail as defined in claim 7, wherein said nail body and said application tab are integrally molded.

12. A set of artificial nails for attachment to natural nails comprising:

at least one nail body having a proximal end sized and shaped to be attachable to the top surface of the natural nail, a distal end opposite said proximal end and a peripheral edge;

an application tab extending outwardly from said peripheral edge of said at least one nail body at a first location, said application tab having a surface adapted to be grasped during attachment of said nail body to the natural nail and having a frangible portion adjacent said peripheral edge of said nail body for detaching said application tab from said nail body, said frangible portion being narrower than said surface, wherein the frangible portion comprises means for allowing the application tab to be easily and cleanly removed from the nail body, without damage to the nail body, by snapping, tearing or breaking, and eliminating or minimizing the need for subsequent filing or shaping of the nail body; and a supporting structure including a frangible stem detachably connected to said peripheral edge of said at least one nail body at a second location for temporarily supporting said nail body thereon.

13. A set of artificial nails as defined in claim 12, wherein said surface of said application tab includes indicia indicating a size of said nail body.

14. A set of artificial nails as defined in claim 13, wherein said indicia indicates a curvature of said nail body.

15. A set of artificial nails as defined in claim 12, wherein said frangible portion includes a perforation.

16. A set of artificial nails as defined in claim 12, wherein said application tab is in the shape of a flat disk.

17. A set of artificial nails as defined in claim 12, wherein said nail body, said application tab and said supporting structure are integrally molded.

18. A set of artificial nails for attachment to natural nails comprising:

at least one nail body having a proximal end sized and shaped to be attachable to the top surface of the natural nail and a distal end opposite said proximal end, said distal end defining a distal edge;

an application tab extending outwardly from said distal edge of said at least one nail body, said application tab having a surface adapted to be grasped during attachment of said nail body to the natural nail and having a frangible portion adjacent said distal edge of said nail body for detaching said application tab from said nail body, said frangible portion being narrower than said surface, wherein the frangible portion comprises means for allowing the application tab to be easily and cleanly removed from the nail body, without damage to the nail body, by snapping, tearing or breaking, and eliminating or minimizing the need for subsequent filing or shaping of the nail body; and a supporting structure including a frangible stem detachably connected to said application tab of said at least one nail body for temporarily supporting said nail body thereon.

19. A set of artificial nails as defined in claim 18, wherein said surface of said application tab includes indicia indicating a size of said nail body.

20. A set of artificial nails as defined in claim 19, wherein said indicia indicates a curvature of said nail body.

21. A set of artificial nails as defined in claim 18, wherein said frangible portion includes a perforation.

22. A set of artificial nails as defined in claim 18, wherein said application tab is in the shape of a flat disk.

23. A set of artificial nails as defined in claim 18, wherein said nail body, said application tab and said supporting structure are integrally molded.

* * * * *